US005925858A

United States Patent [19]

Full et al.

[11] Patent Number: 5,925,858

[45] Date of Patent: Jul. 20, 1999

[54] SAFETY SYSTEM FOR DETECTING SMALL OBJECTS APPROACHING CLOSING DOORS

[75] Inventors: Gary G. Full; Richard D. Pustelniak, both of Tucson, Ariz.

[73] Assignee: Otis Elevator Company, Farmington, Conn.

[21] Appl. No.: 08/876,127

[22] Filed: Jun. 23, 1997

[51] Int. Cl.[6] ..... B66B 13/26

[52] U.S. Cl. ..... 187/317; 49/25

[58] Field of Search ..... 187/313, 317, 187/316, 280; 49/25; 250/221, 349

[56] References Cited

U.S. PATENT DOCUMENTS

| | | | |
|---|---|---|---|
| Re. 30,719 | 8/1981 | Mills | 187/52 R |
| 3,852,592 | 12/1974 | Scoville et al. | 250/221 |
| 4,029,176 | 6/1977 | Mills | 187/52 R |
| 4,706,227 | 11/1987 | DuVall et al. | 187/317 |
| 4,794,248 | 12/1988 | Gray | 187/317 |
| 4,894,952 | 1/1990 | Trett et al. | 49/25 |
| 5,142,152 | 8/1992 | Boiucaner | 250/341 |

FOREIGN PATENT DOCUMENTS

699619A2 3/1996 European Pat. Off. .

*Primary Examiner*—Kenneth Noland

[57] ABSTRACT

A safety system for detecting small objects that approach closing doors comprising a transmitter stack, a detector stack, and a controller including instructions to detect small objects as the doors are closing. A transmitter or a group of transmitters from the transmitter stack are powered sequentially resulting in an output from the detector stack. The controller compares each output from the detector stack with an average of all the outputs plus a threshold value. The outputs that exceed the average plus threshold value trigger the safety system to reverse closing operation of the doors.

4 Claims, 4 Drawing Sheets

FIG. 1
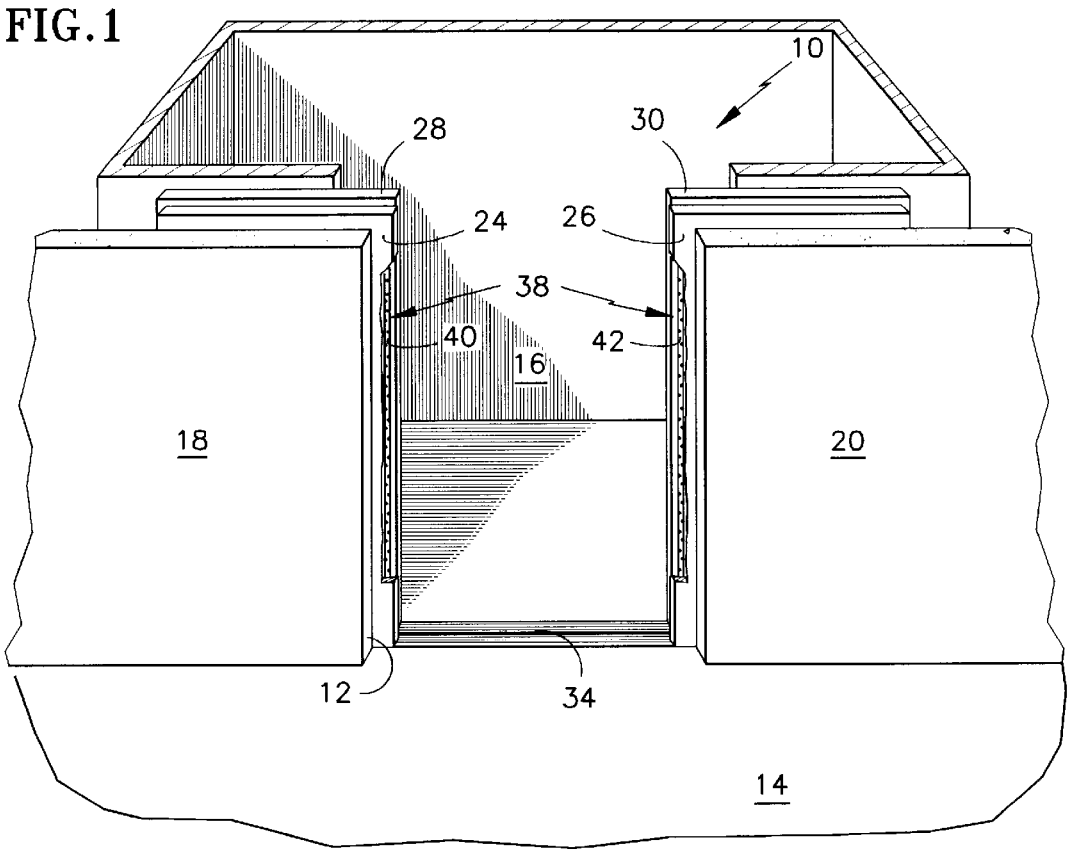
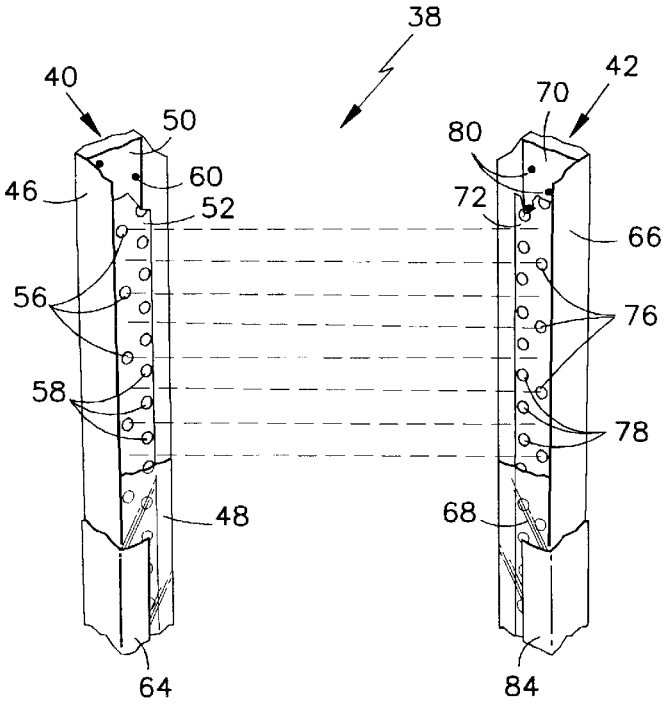
FIG. 2

SAFETY SYSTEM FOR DETECTING SMALL OBJECTS APPROACHING CLOSING DOORS

CROSS-REFERENCE TO RELATED APPLICATIONS

This application is related to commonly owned co-pending applications filed on the same day herewith having Ser. Nos.: 08/876,128 and 08/879,676.

TECHNICAL FIELD

The present invention relates to door systems and, more particularly, to safety detection systems therefor.

BACKGROUND OF THE INVENTION

Many automatic sliding doors are equipped with safety systems intended to detect potential interference with the closing operation of the doors. These safety systems usually include a plurality of signal sources disposed on one door and a plurality of receivers disposed on the other door. The signal sources emit a curtain of signals across the threshold of the door to be detected by the plurality of receivers. When the signal curtain is interrupted, the safety system communicates with a door controller either to cease closing operation and open the doors or to maintain the doors open, depending on the initial position of the doors.

A doorway safety system described in U.S. Pat. No. 4,029,176 to Gerald W. Mills and entitled "Doorway Safety Device" uses acoustic wave transmitters and receivers to detect endangered objects or persons. Not only does the patented system detects objects positioned between the doors and across the threshold, but it also extends the zone of detection into the entryway. The transmitters send out a signal at an angle into the entryway. When an obstruction enters the detection zone, the signal reflects from the obstruction and is detected by the receivers.

Similarly, a published European Patent Application No. EP 0699619A2 to Memco Limited and entitled "Lift Installation for Preventing Premature Closure of the Sliding Doors" describes a three-dimensional system for detecting objects or persons not only across the threshold, but also in the entryway.

One shortcoming of the existing safety systems is detection of objects after the doors have been partially closed. As the doors are closing, the detection zone is also moving and structural obstructions, such as the walls supporting the doors or an outside set of doors, fall within the detection zone. Once the signal is intercepted by a structural obstruction, it is then reflected to another structural obstruction and is subsequently detected by the receivers. As the doors are closing and the distance between the transmitters and receivers becomes progressively smaller, the signal that is reflected from the walls and other architectural obstructions travels shorter distances and still remains strong when received by the receivers. The existing safety systems are not able to discriminate between the signal that is reflected from false targets at relatively short distances between the doors and a signal reflected from a true obstruction. The strong signal overloads the receivers. Thus, as the doors close, the safety systems lose the ability to function properly. Many existing safety systems are turned off at some point during closure to avoid false target detections.

The European patent application described above attempts to solve the problem by reducing the gain of the receivers. However, the downside of reducing the gain in the receivers is that actual targets are also not detected. The inability to discriminate between false targets and real targets as the doors are closing makes impossible for the existing systems to respond to small objects, such as feet or hands, being thrusted between the closing doors or approaching the closing doors.

DISCLOSURE OF THE INVENTION

It is an object of the present invention to improve a safety detection system for sliding doors.

It is another object of the present invention for the safety system to detect small objects that approach closing doors.

According to the present invention, a safety system for detecting objects or persons approaching closing doors includes a detector stack on one door, a transmitter stack on an opposite door, and a means for detecting small objects approaching closing doors. As the distance between closing doors becomes progressively smaller, a safety system controller registers an output from the detector stack as each transmitter is sequentially powered. Each output is then compared to an average of all outputs. If an individual output exceeds the average, it is treated as a valid target and the closing operation of the doors is reversed. Another method for detecting small objects as the doors are closing is a rate of change method.

The present invention allows detection of small objects, such as hands and legs, approaching the closing doors. The present invention minimizes detection of false targets and structural objects.

The foregoing and other advantages of the present invention become more apparent in light of the following detailed description of the exemplary embodiments thereof, as illustrated in the accompanying drawings.

BRIEF DESCRIPTION OF THE DRAWINGS

FIG. 1 is a schematic, partially cut-away, perspective view of a door system with a safety detection system mounted thereon, according to the present invention;

FIG. 2 is a schematic, cut-away, perspective view of a transmitter stack and a detector stack of the safety detection system of FIG. 1;

BEST MODE FOR CARRYING OUT THE INVENTION

Figure 3:
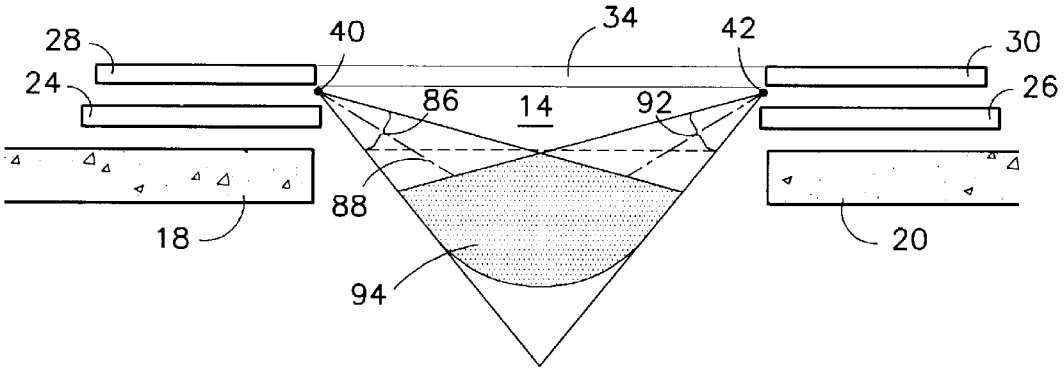
FIG. 3 is a schematic, plan view of the door system with the safety system of FIG. 1 with the fully opened doors.

Referring to FIG. 1, a door system 10 for opening and closing a doorway 12 from a hallway 14 into an elevator cab 16 is adjacent to walls 18, 20 and includes a set of hallway doors 24, 26 and a set of elevator cab doors 28, 30. Both sets of doors 24, 26, 28, 30 slide open and closed in unison across a threshold 34 with the hallway set of doors 24, 26 closing and opening slightly ahead and behind of the cab doors, 28, 30 respectively.

A safety detection door system 38 is disposed on the cab doors 28, 30 adjacent to the hallway doors 24, 26. The safety door system 38 includes a transmitter stack 40 and a detector stack 42, each disposed on opposite sides of the doorway 12 and facing each other.

Referring to FIG. 2, each transmitter stack 40 includes a housing 46 and a transparent cover 48 for protecting a transmitter circuit board 50 and a transmitter lens board 52. The transmitter lens board 52 includes a plurality of transmitter three-dimensional lenses 56 and a plurality of transmitter curtain lenses 58. The transmitter circuit board 50 includes a plurality of transmitters or LEDs (light emitting devices) 60 disposed adjacent to each lens 56, 58 for emitting infrared light. A transmitter barrier 64 supports the housing 46 and partially blocks light for the transmitter three-dimensional lenses 56.

The detector stack 42 is structured as a mirror image of the transmitter stack 40. The detector stack 42 includes a detector stack housing 66 with a transparent detector stack cover 68 for protecting a detector circuit board 70 and a detector lens board 72. The detector lens board 72 includes a plurality of detector three-dimensional lenses 76 and a plurality of detector curtain lenses 78. The detector curtain lenses 78 are disposed directly across from the transmitter curtain lenses 58. The detector three-dimensional lenses 76 are vertically staggered from the transmitter three-dimensional lenses 56. The detector circuit board 70 includes a plurality of detectors or photodiodes 80 adjacent to each lens 76, 78 for detecting light. A detector barrier 84 supports the detector housing 66 and partially blocks light for the detector three-dimensional lenses 76.

The safety system 38 also includes a controller box (not shown) that provides and controls power to the stacks 40, 42, sequences and controls the signal to the stacks 40, 42, and with a door controller (not shown).

In operation, the safety system 38 prevents the cab doors 28, 30 from closing if an object or person is detected either across the threshold 34 or approaching the doorway 12. The transmitter curtain lenses 58 emit a signal across the threshold 34 to the detector curtain lenses 78. If the curtain signal is interrupted when the doors 28, 30 are either open or closing, the safety system 38 communicates to the door controller (not shown) to either maintain the doors opened or reverse the closing operation, respectively. The strength of the curtain signal received at the detector curtain lenses 78 is utilized to determine the distance between the closing doors 28, 30.

Figure 4:
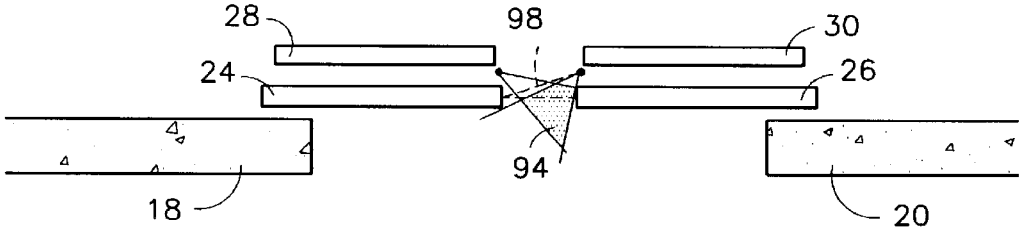
FIG. 4 is a schematic, plan view of the door system with the safety system of FIG. 1 with the doors partially closed.

The transmitter three-dimensional lenses 56 emit a three-dimensional signal at a predetermined angle outward into the hallway 14, as shown in FIGS. 3 and 4. In the best mode of the present invention, the transmitter three-dimensional lenses 56 have a relatively narrow field of view 86 spanning approximately ten degrees (10°) and having a centerline 88 at approximately thirty degrees (30°) angle from the threshold 34 into the hallway 14.

The detectors 80 and detector three-dimensional lenses 76 receive a signal emitted from the transmitter three-dimensional lenses 56 and reflected from an object at a predetermined angle. In the best mode of the present invention, the detector three-dimensional lenses 76 have a relatively broader field of view 92, limited by the physical constraints of the detector stack housing 66 and the detector barrier 84.

The intersection between the field of view 86 of the transmitter three-dimensional lenses 56 and the field of view 92 of the detector three-dimensional lenses 76 defines a detection zone 94. When an object or person enters the detection zone 94, the signal from the transmitter three-dimensional lenses 56 hits the obstruction positioned within the detection zone 94 and is reflected into the detector three-dimensional lenses 76. When the detector three-dimensional lenses 76 receive a signal, the safety system 38 communicates with the door controller to either reverse the closing operation or maintain the doors 28, 30 open.

As the distance between closing doors becomes relatively small, the safety system controller sequentially powers one three-dimensional transmitter 60 at a time. Each three-dimensional transmitter 60 is powered for a preset amount of time, while the remaining three-dimensional transmitters are turned off. In the best mode requirement of the present invention, the preset time for powering each transmitter ranges approximately from 500 to 1000 microseconds. The three-dimensional detectors 80 operate in parallel and function as a single detector.

Figure 5:
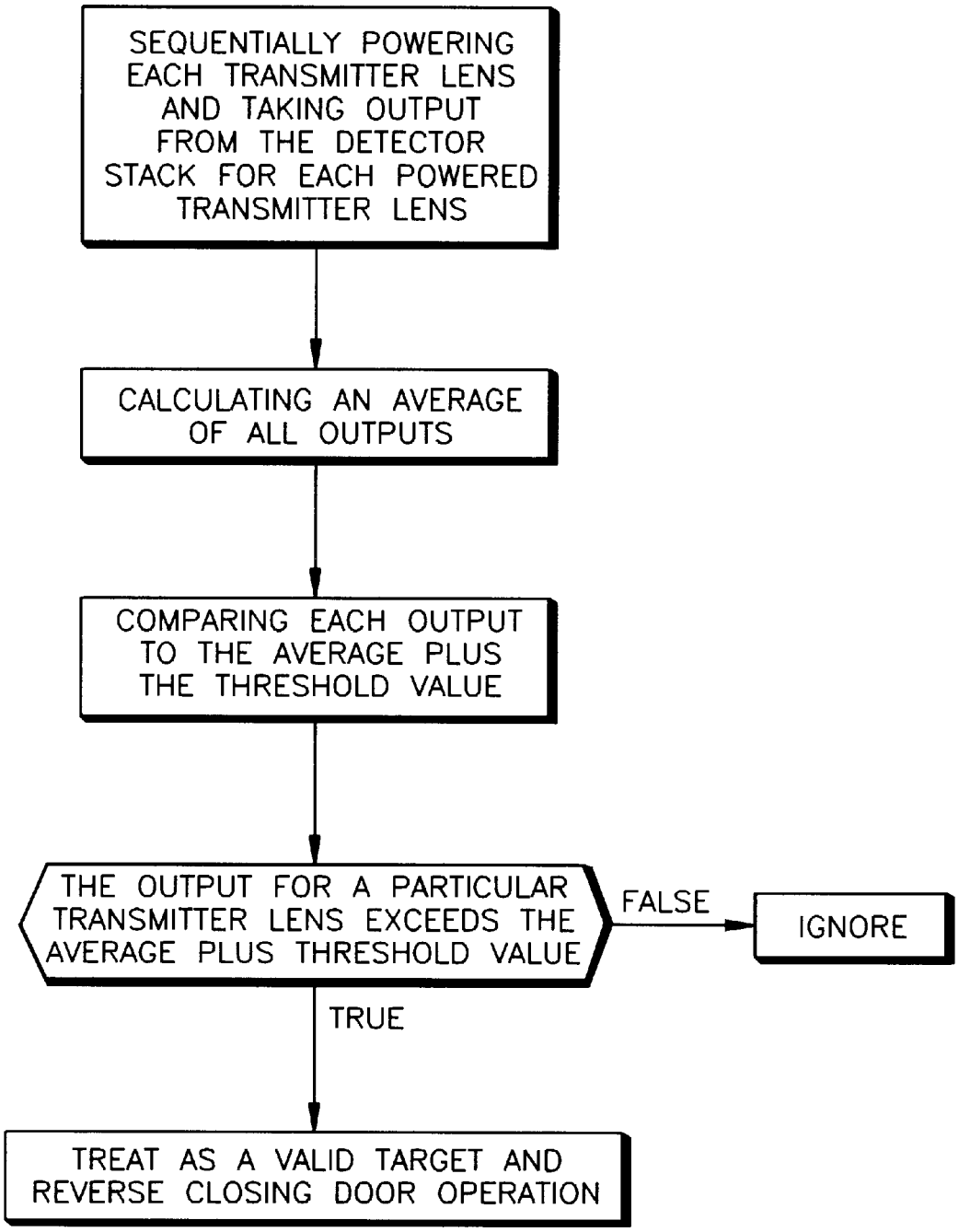
FIG. 5 is a high level, logic flow diagram showing discrimination process between false targets and valid small targets performed by the safety system of FIG. 1 when the doors are close together.

Referring to FIG. 5, as each three-dimensional transmitter is powered sequentially, the safety system controller (not shown) registers an output from the detector stack each time a three-dimensional transmitter is powered. Once the safety system controller obtains an output from the detector stack for every three-dimensional transmitter, an average output is calculated. Each output is then compared to the average output plus a preset threshold value. If the output for a particular three-dimensional transmitter is less than the average output plus the threshold value, then the reading is ignored. If the output for the particular three-dimensional transmitter exceeds the average output plus the threshold value, then the reading is treated as a valid target. The safety system controller then communicates with the door system controller to reverse the closing operation of the doors.

Figure 6:
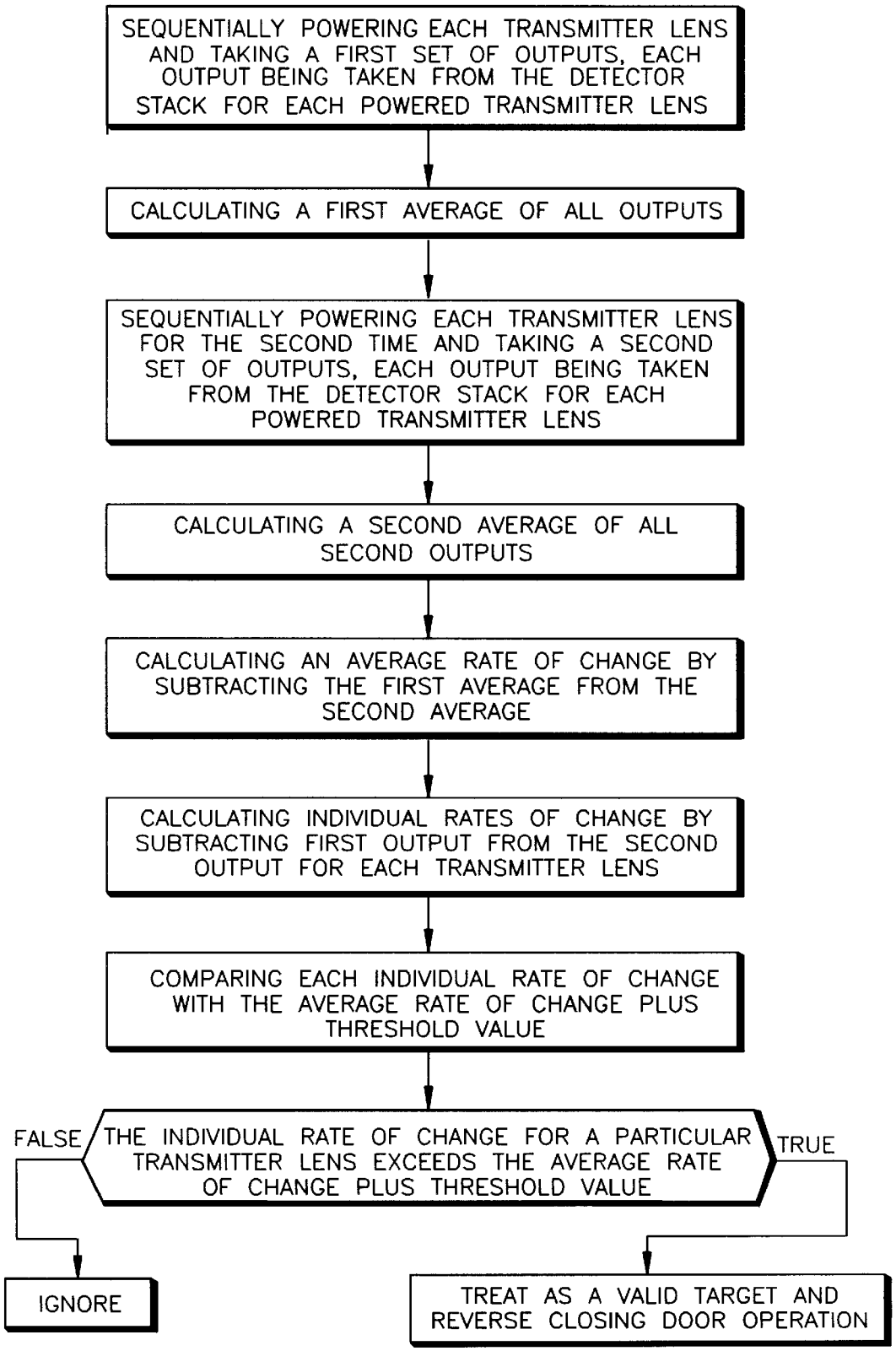
FIG. 6 is a high level, logic flow diagram showing another discrimination process between false targets and valid small targets performed by the safety system of FIG. 1 when the doors are close together.

Referring to FIG. 6, when the distance between the closing doors is very small and the method described above may no longer provide adequate discrimination between small objects and false targets, the safety system controller follows a rate of change detection method. The safety system controller registers a first set of outputs, each output from the detector stack corresponding to each powered three-dimensional transmitter. The safety system controller then calculates a first average for the first set of outputs. The safety controller registers a second set of outputs, each output from the detector stack corresponding to each powered three-dimensional transmitter as the controller sequences through the three-dimensional transmitters for the second time. The safety system controller then calculates a second average of the second set of outputs. An average rate of change is then calculated by subtracting the first average from the second average. Subsequently, a plurality of individual rates of change are calculated by subtracting the first outputs from the second outputs for each three-dimensional transmitter, therefore, obtaining an individual rate of change for each three-dimensional transmitter. Each individual rate of change for each three-dimensional transmitter is then compared with the average rate of change plus a preset threshold value. If the individual rate of change is less than the average rate of change plus a preset threshold value, then the reading is ignored. If the individual rate of change exceeds the average rate of change plus a preset threshold value, then the reading is treated as a valid target. The safety system controller then communicates with the door system controller to reverse the closing operation of the doors because a very small object was detected within the detection zone.

The overall effect of the logic is to reject signals that are of nearly the same magnitude over the vertical span of the detector stack, even if the signals themselves may be quite strong. For example, if a signal was reflecting from one hallway door to the opposite hallway door and then into the detector three-dimensional lens, the safety system would ignore the signal. However, a small object such as an arm or hand would result in a strong signal in a small vertical area. The safety system would then recognize the strong signal in a small vertical area as a small object and reverse closing operation of the doors.

The method for detecting small objects shown in FIG. 5 is most effective for distances between the closing doors of approximately between one foot and two feet (1'–2'). The rate of change method shown in FIG. 6. is also effective for distances of two feet (2') or less, and continues to be effective for distances of approximately one foot (1') or less between the closing doors. The safety system controller determines the distance between the closing doors based on the strength of the curtain signal. The threshold value for both methods is arbitrary and is used to avoid false target detection.

Both methods for detecting small objects that approach closing doors allow the safety system to discriminate between a structural obstruction and a small target. As the doors are closing, the detection zone 94 moves closer toward the opposite door and also closer to the architectural structures, such as walls or the hallway doors, as best seen in FIG. 4. When an architectural structure is within the detection zone 94, the present invention allows detection of small objects, such as hands and legs, approaching closing doors. In contrast to the present invention, the existing safety systems do not have the capability of discerning small objects and therefore result in either false target detection or tend to turn off the safety detection system at small distances between closing doors.

Although the best mode of the present invention describes double sliding elevator doors, the present invention is also applicable to single sliding doors, vertical sliding doors and other similar door systems. In single sliding door configuration, one of the stacks can be mounted on the door, whereas the second stack can be mounted on the wall across the doorway. In a vertical door configuration, frequently used in freight elevators, stacks can be mounted horizontally.

While the present invention has been illustrated and described with respect to a particular embodiment thereof, it should be appreciated by those of ordinary skill in the art, that various modifications to this invention may be made without departing from the spirit and scope of the present invention. For example, the best mode of the present invention shows and describes a staggered pattern for the three-dimensional transmitters and the three-dimensional detectors. However, for the purposes of the present invention, any pattern of the three-dimensional transmitters and detectors is suitable. Furthermore, other energy sources can be used as transmitters. Although the best mode of the present invention describes three-dimensional transmitters being powered one at a time, transmitters may be powered individually, or in small groupings.

We claim:

1. A safety system for detecting an obstruction approaching sliding doors in a hallway, said safety system comprising:

a plurality of transmitters emitting a signal into said hallway at a preset range of angles;

a plurality of detectors receiving said signal reflected from said obstruction; and a controller including instructions for discriminating between false targets and small objects as said sliding doors are closing;

wherein said instructions select an output from a detector stack that exceeds an average value of all said outputs, each said output being taken as each of said plurality of transmitters is powered sequentially.

2. A safety system for detecting small objects approaching a set of closing doors in a hallway comprising:

a plurality of three-dimensional transmitters emitting a signal into said hallway at a preset range of angles, each of said plurality of transmitters being powered sequentially;

a plurality of detectors receiving said signal reflected from said obstruction, said plurality of detectors having an output as each of said plurality of transmitters is being powered; and a means for selecting a registered output that exceeds an average of all said outputs plus a threshold value to reverse closure of said sliding doors.

3. A method for detecting small objects approaching a set of closing doors, said method comprising the steps of:

powering sequentially each transmitter;

taking an output from a detector stack for each said powered transmitter;

calculating an average of all said outputs;

comparing each said output to said average plus a threshold value;

selecting said output having value exceeding said average plus said threshold value; and reversing closing door operation upon detection of said output exceeding said average plus said threshold value.

4. A method for detecting small objects approaching a set of closing doors, said method comprising the steps of:

powering sequentially transmitters;

taking a set of first outputs, each said first output being taken from a detector stack for each said transmitter being powered for the first time;

calculating a first average of all said first outputs;

powering sequentially each said transmitter for the second time;

taking a set of second outputs, each said second output being taken from said detector stack for each said transmitter powered for the second time;

calculating a second average for all said second outputs;

calculating an average rate of change by subtracting said first average from said second average;

calculating individual rates of change by subtracting said first output from said second output for each said transmitter;

selecting said individual rates of change for particular said transmitter exceeding said average rate of change plus a threshold value; and reversing closing operation of said doors for said individual rates of change that exceed said average rate of change plus said threshold value.

* * * * *